US007276688B2

(12) United States Patent
Weiss

(10) Patent No.: US 7,276,688 B2
(45) Date of Patent: Oct. 2, 2007

(54) ION-OPTICAL PHASE VOLUME COMPRESSION

(75) Inventor: Gerhard Weiss, Weyhe (DE)

(73) Assignee: Bruker Daltonik GmbH, Bremen (DE)

( * ) Notice: Subject to any disclaimer, the term of this patent is extended or adjusted under 35 U.S.C. 154(b) by 11 days.

(21) Appl. No.: 11/088,682

(22) Filed: Mar. 24, 2005

(65) Prior Publication Data

US 2005/0274902 A1 Dec. 15, 2005

(30) Foreign Application Priority Data

Mar. 25, 2004 (DE) ..... 10 2004 014 582

(51) Int. Cl.
*H01J 49/40* (2006.01)
*H01J 49/42* (2006.01)

(52) U.S. Cl. ..... 250/288; 250/287; 250/282; 250/281; 250/292

(58) Field of Classification Search ..... 250/292, 250/288, 281, 282, 287
See application file for complete search history.

(56) References Cited

U.S. PATENT DOCUMENTS

| | | | | |
|---|---|---|---|---|
| 3,258,591 A | | 6/1966 | Blauth et al. | |
| 3,665,185 A | * | 5/1972 | Goff | 250/282 |
| 3,920,990 A | * | 11/1975 | Van Nieuwland et al. | 250/309 |
| 3,970,849 A | * | 7/1976 | Brongersma et al. | 250/281 |
| 4,100,409 A | * | 7/1978 | Brongersma | 250/305 |
| 4,213,557 A | | 7/1980 | Franzen et al. | |
| 4,963,736 A | | 10/1990 | Douglas et al. | |
| 5,206,506 A | | 4/1993 | Kirchner | |
| 5,572,035 A | | 11/1996 | Franzen | |
| 5,847,386 A | | 12/1998 | Thomson et al. | |
| 6,559,444 B2 | * | 5/2003 | Franzen | 250/293 |
| 6,674,071 B2 | * | 1/2004 | Franzen et al. | 250/292 |

(Continued)

FOREIGN PATENT DOCUMENTS

| | | |
|---|---|---|
| EP | 1 365 438 A2 | 10/2002 |
| GB | 2 378 312 A | 2/2003 |

OTHER PUBLICATIONS

Über nichtlineare Resonanzen im elektrischen Massenfilter als Folge von Feldfehlern, F. v. Busch and W, Paul Zeitschrift für Physik 164, 588-594 (1961).

(Continued)

*Primary Examiner*—Robert Kim
*Assistant Examiner*—Johnnie L. Smith, II
(74) *Attorney, Agent, or Firm*—Law Offices of Paul E. Kudieka

(57) ABSTRACT

The invention relates to a method for damping the kinetic energy of ions in ion cells filled with collision gas and with an exit aperture to drain the ions out of the cell. The invention uses a conditioning cell with an adjustable DC potential which decreases towards the exit aperture to compress the phase volume of the ions by damping their kinetic energies, collecting the ions after thermalization in the spatial potential minimum thus created and letting them drain away relatively slowly through a central potential minimum in the exit aperture system. This facilitates the production of very fine, highly parallel ion beams which consist of almost monoenergetic ions. In particular, the method can also be coupled with a fragmentation of the ions.

9 Claims, 4 Drawing Sheets

U.S. PATENT DOCUMENTS

| | | | | |
|---|---|---|---|---|
| 6,700,117 | B2 * | 3/2004 | Franzen | 250/287 |
| 6,762,404 | B2 * | 7/2004 | Bateman et al. | 250/281 |
| 6,791,078 | B2 * | 9/2004 | Giles et al. | 250/286 |
| 2003/0136905 | A1 * | 7/2003 | Franzen et al. | 250/292 |
| 2005/0040326 | A1 * | 2/2005 | Enke | 250/288 |

OTHER PUBLICATIONS

Performance of the Quadrupole Mass Filter With Separated RF and DC Fringing Fields; P.H. Dawson; Division of Physics, National Research Council, Ottawa, KIA OR6; Apr. 18, 1977.

* cited by examiner

ION-OPTICAL PHASE VOLUME COMPRESSION

FIELD OF THE INVENTION

The invention relates to a method for damping the kinetic energy of ions in ion cells filled with collision gas and with an exit aperture to drain the ions out of the cell.

BACKGROUND OF THE INVENTION

Some types of mass spectrometers, for example time-of-flight mass spectrometers with orthogonal ion injection, require a very well-conditioned ion beam for high mass resolution and precise mass determination. By a "well-conditioned ion beam" we mean here a beam of ions flying as parallel as possible with kinetic energies which are as uniform as possible. This "ion beam conditioning" can consist in first decelerating the motion of the ions in a conditioning cell by numerous collisions with a collision gas, drawing the decelerated ions out of the conditioning cell through suitable diaphragm systems, and then forming them into a relatively fine, almost parallel ion beam. The process of reducing the kinetic energy of the ions by decelerating them in a collision gas is termed "thermalization". This reduces the "phase volume" of the ions. By "phase space" we mean the six-dimensional space made up of space and momentum coordinates measured in an entrained system of coordinates; by "phase volume" we mean that part of the phase space which is filled with ions. Good beam conditioning always requires compression of the phase volume.

For a time-of-flight mass spectrometer with orthogonal ion injection, high mass resolution requires that a fine ion beam as parallel as possible with a diameter of only 0.5 millimeters if possible be generated, whereby the energy of the ions in the beam should be as uniform as possible, for example 20 electron volts with deviations of less than 0.5 electron volts. Ions from normal ion feeding systems, for example RF ion guidance systems, have a much larger phase volume and therefore have to be conditioned before being fed into a mass spectrometer of this type.

Conditioning the ions by reducing their phase volume like this cannot be achieved by ion-optical methods (a consequence of the Liouville theorem) and with the exception of the complicated method of laser cooling, only the gas cooling described can reduce the phase volume. U.S. Pat. No. 4,963,736 (D. J. Douglas and J. B. French) describes an RF-operated ion guidance system which conditions the ions by cooling them for optimum injection into a mass-selective quadrupole filter.

Ion storage cells filled with collision gas have proved successful in reducing the phase space, whereby the cells consist, for example, of four round rods positioned between the diaphragm systems on the input side and output side, and which use a supply with both phases of an RF voltage to build up an essentially quadrupole alternating field which, in conjunction with retaining potentials on the diaphragm systems, retains the ions in the storage cell.

The demands on the conditioning cells are particularly high if it is intended that the conditioning cells will also be used for the fragmentation of ions, i.e. when it is intended that the deceleration gas will be simultaneously also used as the collision gas for a fragmentation. For fragmentation, the ions are injected into the collision-gas filled system with kinetic energies of between 30 and 200 electron volts. The fragmentation process is denoted by the abbreviation CID (collisionally induced decomposition); the fragmentation occurs only after many collisions, when the ion has absorbed sufficient intrinsic energy as a result of the high proportion of collisions to lead to the fragmentation of a bond. Regardless of whether the ions are fragmented or not, they are also kinetically cooled in the collision gas simultaneously and in competition with the fragmentation, i.e. their kinetic energy decreases. The fragmentation process in these quadrupole systems would proceed more effectively in collision gases with a heavier molecular weight; these heavier gases cannot be used, however, since their gas molecules deflect the ions more strongly to the side during collisions and it is then very easy for the ions, as a result of such collision cascades, to escape laterally out of the round-rod quadrupole system.

All current tandem mass spectrometers require collision cells for the fragmentation of one species of ion (the "parent ions") in order to obtain information about the structure of the parent ions by analyzing the fragment ion spectrum (or "daughter ion spectrum"). In general, the parent ions are selected from a primary ion mixture by a quadrupole filter; then fragmented in the collision cell; after fragmentation, the daughter ions can be analyzed in quadrupole mass spectrometers, time-of-flight mass spectrometers with orthogonal ion injection, in RF ion traps or in ion cyclotron resonance spectrometers.

For many years, RF quadrupole systems have been used as collision cells, which are usually constructed of round rods and operated with purely RF voltage without superimposed DC voltage (in the so-called "RF-only mode"), usually with helium as the collision gas (sometimes with nitrogen), and in which both the parent and also the daughter ions remain trapped as well as possible. Mass spectrometers which use quadrupole filters near the inputs and near the outputs to select or analyze ions have become known as "Triple-Quads", for obvious reasons; these Triple-Quads have been known for around 15 years.

Collision cells usually consist of RF rod systems with round rods, although for high-quality quadrupole mass spectrometers, hyperbole systems, which permit significantly better separation efficiency and transmissions, have established themselves in the last 30 years. Inexpensive round-rod systems are still considered good enough for the collision chambers, expensive hyperbole systems are not used at all.

From the work of F. von Busch and W. Paul, Z. Phys. 164,588 (1961), however, it is already known that in round-rod quadrupole filters, non-linear resonances exist which lead to the ejection of those ions whose motion parameters lie in the middle of the "Mathieu stability zone" and which should therefore be collected in a stable state. In three-dimensional RF ion traps, these resonances lead to the phenomenon of "black holes", which occur in the same way in rod systems, particularly in round-rod systems. Round-rod systems contain octopole and higher even-numbered multipole fields of considerable strength superimposed on the quadrupole field, leading to a distortion of the ion oscillations in the radial direction and hence to the formation of overtones of the ion oscillation. Their meeting with the Mathieu side bands leads to the resonances, which only occur, however, when the ions sweep through relatively wide radial oscillations. For ions lying damped in the axis of the system, the resonances are not effective. The Mathieu stability field is traversed by numerous non-linear resonance lines, the resonances are by no means rare.

Now it is precisely the case in collision cells that the ions injected with higher energies of between 30 and 200 electron volts must reach the vicinity of the rods or their intermediate areas in large numbers by means of collision cascades, and they are therefore inevitably subjected to the phenomenon of non-linear resonances if they fulfill the resonance conditions. Specific species of daughter ions can thus disappear from the collision cell and hence out of the daughter ion spectrum and thus adulterate the spectrum of the daughter ions. In the most unfavorable case, even the selected parent ions are subjected to this resonance and disappear to a large extent from the collision cell.

Apart from this, round-rod systems have the further disadvantage that the pseudopotential wall between the rods is extremely low (for commercially available systems only some ten to twenty volts) and can easily be overcome by ions with an energy of 50 electron volts, usually the minimum energy required for fragmentation processes, by means of a random laterally-deflecting collision cascade. This escape affects both parent and daughter ions. The higher the mass of the collision gas molecules, the more ions are lost, because in this case, the angles of deflection per collision are greater. A cascade of a few collisions which coincidentally deflect in the same lateral direction is enough to remove the ion from the collision cell. In the case of a very light collision gas, the larger angles of deflection of a small number of collisions are no longer able to compensate statistically as well as the large number of smaller angles of deflection.

As far as the conditioning of the ions is concerned, a disadvantage of most collision cells is that either the ions leave the cell again with relatively high energy after sweeping through once, since their energy has not been sufficiently reduced by collisions, or that, after a sufficiently large number of collisions (after a long sweep at high pressure or also after several sweeps with reflections at the ion output) they have given up their kinetic energy apart from residues of thermal energy and then remain in the collision cell. There has been a long search for collision cells which make it possible to construct an axial DC voltage drop to fish out the fragmented and thermalized ions from the collision cell in an efficient and uniform manner. The DC voltage drop needs only to be a few volts.

The easiest way to generate a DC voltage drop is in a quadrupole electrode system made of four thin resistance wires. The thin wires require an extremely high RF voltage, however, in order to build up the quadrupole RF field since the largest voltage drop occurs in the immediate vicinity of the thin wire. In addition, the resistance must not be particularly high, otherwise the RF alternating voltage cannot propagate along the wires sufficiently quickly. It is therefore only possible to generate very low DC voltage drops along the wire. Moreover, the pseudopotential wall between the wires is very low; the ions can escape very easily. Furthermore, the proportion of higher multipole fields is very high. Hyberbolic quadrupole systems comprising a large number of clamped parallel wires which imitate the four hyperbolic areas of the ideal quadrupole system provide a way out. Quadrupole systems replicated in wire like this were already being used around 40 years ago in the laboratories of Wolfgang Paul, the inventor of all quadrupole systems. These quadrupole systems are difficult to produce, however, and not very precise.

Another type of ion storage system with an electrically switched forward thrust is known from patent specification U.S. Pat. No. 5,572,035 (J. Franzen). The patent specification relates to various types of ion guidance systems which are completely different to the rod and wire systems described here. One of these consists of only two helical, coiled conductors in the shape of the double helix, operated by connection to the two phases of RF voltage. Another consists of coaxial rings connected in turn to the phases of RF alternating voltage. Both systems can be operated so that an axial forward thrust of the ions is generated. The double helix can be produced from resistance wire across which a DC voltage drop is generated, in a similar way to the quadrupole rod system made of thin wires; since the double helix is more compatible with thinner wires, however, and also has longer wires, it is more suitable for the DC voltage drop. The individual rings of the ring system can be supplied with a DC voltage potential which decreases in stages ring by ring, as also described in the patent.

Further solutions for collision cells which permit a thrust of the ions along the axis in the interior of the system are described in U.S. Pat. No. 5,847,386 (B. A. Thomson and C. L. Jolliffe) and protected by patent. All these systems are based on round rods:

(a) a segmented quadrupole system made of a chain of a few short rod systems whose potential on the axis falls off in stages;
(b) a quadrupole rod system made of conically tapering rods running parallel to the axis;
(c) a quadrupole rod system whose rods are arranged conically against each other;
(d) a quadrupole system of parallel rods with externally encompassing rings at DC voltage potentials which decrease step by step and which reach into the interior of the rod system where they generate a decreasing potential on the axis;

(e) a quadrupole rod system whose nonconducting rods have an externally applied resistance layer across which a voltage drop is generated (better than the quadrupole system made of thin resistance wires);
(f) a quadrupole rod system made of insulating thin-walled ceramic tubes, with an external resistance layer for a DC voltage drop and an internal metal layer for the RF feed which acts through the insulator to the outside;
(g) a quadrupole rod system with auxiliary electrodes at weak DC voltage potential between the rods, whereby the auxiliary electrodes are arranged so as to taper to the axis of the system. The auxiliary electrodes are each located at the point of the zero potential of the two-phase RF voltage which is applied alternately across the rods. This generates a potential on the axis with potential gradient along the axis.

These arrays are, however, not completely satisfactory: partly because they are complicated to produce and therefore not particularly cheap, and partly because they function only moderately satisfactorily. The transitions between the split quadrupole systems thus present transmission losses and reflections in System (a). System (g) with the long auxiliary diaphragms between the rods exhibits larger ion losses in practice as a result of touching the auxiliary electrodes, which fundamentally decrease the height of the pseudopotential wall between the rods. This system has only limited suitability for the fragmentation of ions since the fragmentation always scatters the ions as well, and the losses are therefore much too high. The nonconducting rods (e) with resistance coating only partially conduct the RF voltage since here the higher capacity of the system compared with the thin wires means larger currents must be carried; or conversely, the resistance coating must really have an extremely low resistance. The ion guidance system (c), which is tapered instead of cylindrical, drives practically only those ions forward which have not collected at rest in the axis of the system, since only these experience a potential with a forward thrust. Almost the same is true for the rod system (b) comprising tapering rods. System (f) comprising thin ceramic tubes (according to the description tube walls around 0.5 to 1 millimeter thick) with interior metal coating to generate the RF field, and exterior resistance layer for the DC voltage drop, has disadvantages: the RF frequency causes such high dielectric losses in the material of the ceramic tubes that the system becomes extremely hot within a very short time and practically glows in the vacuum.

DE 102 21 468 A1 (J. Franzen and A. Brekenfeld) presents further systems with axial DC voltage drop, which are essentially based on the effect of DC voltages on externally encompassing tapering or trumpet-shaped electrodes.

It should be mentioned also that all rod systems into which external DC voltage potentials reach, as in U.S. Pat. No. 5,847,386, case (d) or (g), or as in DE 102 21 468 A1, are disadvantageous. The DC potential on the axis of the rod system is raised, thereby disturbing the parabolic minimum of the pseudopotential in the axis. In a quadrupole system of this type, four new potential minima in which the ions can oscillate are created between the axis and the rods. The possible oscillation amplitudes for the ions are extremely limited, however; the ions can easily collide with the rods and be lost through discharge.

The best systems are those which leave the parabolic minimum in the axis of the rod system undisturbed yet generate a DC voltage drop, as is the case with the rod system made of thin resistance wires or case (g) from U.S. Pat. No. 5,847,386, whose basic principle of the dielectric penetrated by RF has also been known for a long time. Every conductor radiates RF, whether it is insulated or not. A cylinder made of resistance material penetrated by RF has also been known as a "leaky dielectric" for some time (P. H. Dawson, "Performance of the Quadrupole Mass Filter with Separated RF and DC Fringing Fields", Int. J. Mass Spectrom. Ion Phys., 25 (1977) 375-392. Cited is: W. L. Fite, Rev. Sci. Instrum., 47 (1976) 326).

Multipole systems of a higher order can also be used as a collision cell. Such multipole systems comprise more than just two rod pairs. With more than two rod pairs, hexapole, octopole, decapole, dodecapole fields etc. are created. Both phases of a two-phase RF voltage are applied across two neighboring rods. Walls of a so-called pseudopotential then develop between the rods, as is the case with the quadrupole system, these walls hold the ions in the interior of the rod system. In contrast to the quadrupole system, the pseudopotential forms a flat trough in the vicinity of the axis in which the thermalized ions collect further away from the axis than is the case with the parabolic minimum of a quadrupole system. The more rod pairs there are, the shallower the trough. Multipole systems are therefore not as suitable as quadrupole systems for beam conditioning. In octopole systems, it is even possible to observe that the Coulombic repulsion of the ions causes them to collect around the fringes; the axis has a much lower ion density. For some types of mass spectrometer, the higher multipole systems cannot therefore be used as a collision cell for the analysis of the daughter ions owing to their poor beam conditioning.

Time-of-flight mass spectrometers with orthogonal injection of a primary ion beam possess a so-called pulser at the beginning of the flight path which accelerates a section of the primary ion beam, i.e. a string-shaped ion package, at right angles to the previous direction of the beam. This forms a ribbon-shaped secondary ion beam in which light ions fly quickly and heavier ones more slowly, and whose direction of flight lies between the previous direction of the primary ion beam and the direction of acceleration at right angles to this. A time-of-flight mass spectrometer of this type is preferably operated with a velocity-focusing reflector which reflects the whole width of the ribbon-shaped secondary ion beam and directs it towards a similarly extended detector.

If all ions fly in a line exactly in the axis of the pulser, and if the ions have no velocity components transverse to the primary ion beam, then theoretically—as can easily be understood—an infinitely high mass resolution power can be achieved, since all ions with the same mass fly precisely in the same front and reach the detector at precisely the same time. If the primary ion beam has a finite cross section, but no ion has a velocity component transverse to the direction of the beam, then spatial focusing of the pulser again theoretically means an infinitely high mass resolution can be achieved. The high mass resolution can even still be achieved if a strict correlation exists between the ion location (measured from the beam axis of the primary beam in the direction of the acceleration) and the ion transverse velocity in the primary beam in the direction of the acceleration. If no such correlation exists, however, i.e. if ion locations and ion transverse velocities are statistically distributed with no correlation between the two distributions, then it is no longer possible to achieve high mass resolution.

The primary ion beam must therefore be conditioned with respect to location and velocity distribution in order to achieve a high mass resolution in the time-of-flight mass spectrometer.

Beam conditioning is also required for other types of mass spectrometer, or at the very least it is useful. Every mass spectrometer has a phase space acceptance cross section which determines which of the injected ions are accepted and which deflected or reflected.

SUMMARY OF THE INVENTION

The invention uses a conditioning cell with an adjustable DC potential which decreases towards the exit aperture to compress the phase volume of the ions by damping their kinetic energies, collecting the ions after thermalization in the spatial potential minimum thus created and letting them drain away relatively slowly through a central potential minimum in the exit aperture system. This facilitates the production of very fine, highly parallel ion beams which consist of almost monoenergetic ions. In particular, the method can also be coupled with a fragmentation of the ions.

The invention provides a method in which a fine monoenergetic ion beam is produced by steps including:

(a) injecting ions into a conditioning cell filled with a collision gas thereby thermalizing the ions, the collision cell having a diaphragm system to drain the ions out of the conditioning cell;

(b) collecting the ions in a DC potential well in front of the diaphragm system; and (c) draining the ions out of the conditioning cell via a fine overflow potential minimum in the diaphragm system.

This generates the desired fine beam with ions displaying high energy homogeneity. Here, the potential minimum in the diaphragm system, viewed in the plane of the apertured diaphragms, is a point-shaped potential minimum directly at the center of the apertured diaphragms, with the potential increasing radially very quickly to a high barrier potential. A wall with a narrow channel forms along the axis of the electrode system and acts as the overflow.

On the one hand, the method can run continuously by having simultaneous and continuous ion introduction, thermalization, collection and draining over a pre-determined time interval. On the other, it can be also be discontinuous, in which case introduction, thermalization and collection form the first phase of the method, and the draining forms a second phase, whereby during the draining, the voltage drop along the conditioning cell can be temporally changed to make it possible for the draining to continue until the potential well is empty. This process can be repeated a number of times.

The method can use a conditioning cell constructed of parallel ring electrodes. The generation of a potential gradient in such a cell is known from patent specification U.S. Pat. No. 5,572,035. It is also possible, however, to use a conditioning cell consisting of two or more helical, coiled wires. In this case also, the generation of a potential gradient is known from the patent specification cited.

Lastly, it is possible to use a conditioning cell consisting of longitudinal electrodes in which a multipole RF field is present.

The conditioning cell uses in particular four longitudinal electrodes which generate a quadrupole field, because this quadrupole field possesses a well-formed pseudopotential minimum. The generation of DC voltage potential gradients in such quadrupole systems is described below. To avoid ion losses, the quadrupole RF field can be generated so as to be as free as possible from superimpositions with higher multipole fields by designing the longitudinal electrodes which generate the RF field with a hyperbolic shape towards the interior.

A DC voltage potential gradient can be generated by longitudinal electrodes equipped with electrically conductive surface layers and each separated from the RF-carrying longitudinal electrode below by a thin insulating layer and supplied with a mixture of RF and DC voltages. The potential gradient is generated via a DC voltage drop across the electrically conductive surface layers. This keeps the pseudopotential minimum in the axis. When plotted over a cross-sectional area of the quadrupole system, this minimum has the shape of a rotary paraboloid. Thermalized ions collect exactly in the axis of the quadrupole system.

It may be desirable to select at least two individually adjustable potential gradients along the quadrupole system; this can be achieved by them each having at least one through-hole plating of the surface layers to the longitudinal electrode below. If the longitudinal electrodes are hyperbolic in shape, the insulated surface layer only needs to cover the hyperbolic part of the longitudinal electrode.

For the task of collisionally induced fragmentation, it is particularly favorable to use hyperbolic electrodes since, here, the risk of losses due to collision cascades and nonlinear resonating daughter ions is particularly high. Before being put into operation, the collision cell is filled, as usual, with a collision gas at a pressure of between $10^{-2}$ and $10^{+2}$ Pascal, the ions to be fragmented are injected from one of the ends with energies of between 30 and 200 electron volts.

A hyperbolic quadrupole system has the advantage over the round-rod systems regularly used nowadays in that, firstly, there is no escape via nonlinear resonances and, secondly, the pseudopotentials arising from the axis in all radial directions have the same slope, i.e., supply the same restoring forces. The escape of ions via too low a pseudopotential wall between the pole rods as a result of laterally deflected collision cascades is almost completely prevented; if ions at all get lost from this system it is by the rare cases of colliding with the electrodes.

The mixture of RF and DC voltages for the DC voltage drop along the system can be generated using an air core transformer whose secondary windings are each designed to take both phases at least twice so that the DC voltage potentials can be fed into the cold center taps of two secondary windings. Three secondary windings are favorable: one winding serves to supply the RF for the hyperbolic electrodes, and two windings serve to supply the superimposed DC voltage. This enables two independent potential gradients to be generated.

DETAILED DESCRIPTION

Figure 1:
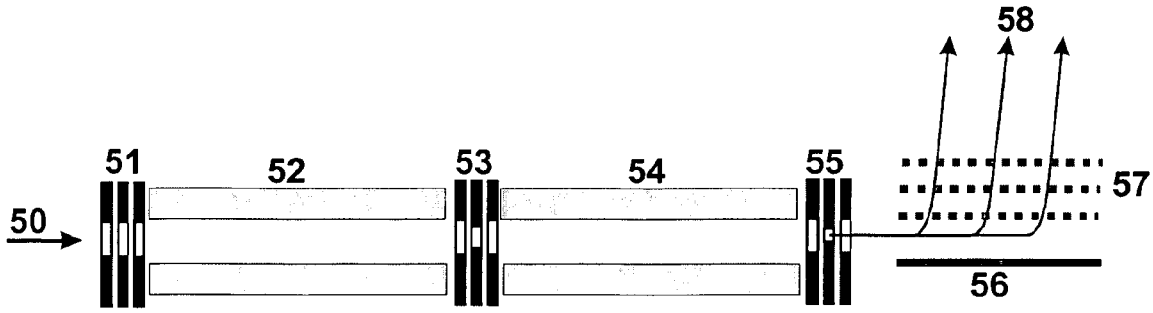
FIG. 1 shows the scheme of a collision and conditioning cell according to the invention in a tandem mass spectrometer. The ion beam (50) is injected through the diaphragm system (51) into a quadrupole system (52) to select the parent ions; the parent ions selected are accelerated through the diaphragm system (53) and injected into the quadrupole system (54) forming the collision cell where they are fragmented; finally, thermalized fragment ions and the remaining parent ions are threaded through the potential overflow in the diaphragm system (55) into the pulser (56) of a time-of-flight mass spectrometer where they are accelerated, locally focused, through the accelerating electrodes (57) as an ion beam (58) into the flight path.

A preferred embodiment of the method for producing a fine ion beam with ions displaying homogeneous energies consists in using a hyperbolic quadrupole system which facilitates the generation of an axial potential gradient, roughly the quadrupole system (54) in FIG. 1, in conjunction with a diaphragm system (55) at the ejection end of the quadrupole system. The ions can be introduced through an injection diaphragm system (53) into the interior of the quadrupole system, for example. A glass quadrupole system (1) shown in FIG. 3 can be used as the quadrupole system, for instance. For this, the quadrupole system is filled with collision gas at a pressure of between $10^{-2}$ and $10^{+2}$ Pascal, causing the ions to thermalize more or less rapidly, i.e. they give up their kinetic energy to the collision gas keeping only thermal residual energies. The restoring forces of the pseudopotential cause the ions having lost their kinetic energy, to collect in the axis of the quadrupole system.

Figure 2:
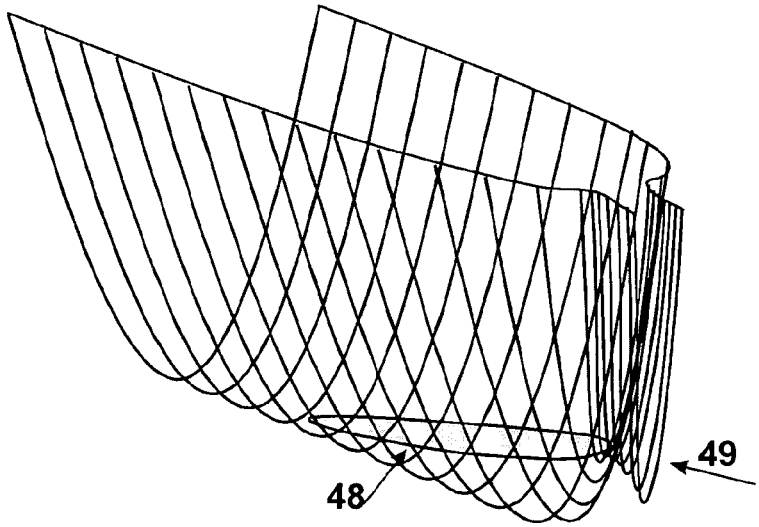
FIG. 2 shows a three-dimensional diagram of the potential well with exit channel at the end of the collision cell, shown as a longitudinal section of the collision cell. The parabolic potential minima of the quadrupole system decrease towards the exit end and are terminated by the potential distribution of the apertured diaphragm system. An ion pool is formed in the potential well with a surface (48) whose ions can drain away through the narrow exit potential channel (49) in the apertured diaphragm system.

By switching on a weak DC voltage drop across the electrically conductive surface layer of the quadrupole system (1), the ions are driven slowly in the axis to the exit end of the quadrupole system. By applying DC voltages across the diaphragm system (55) (FIG. 1) on the exit side in this case, a potential barrier can be set up so that here in the end of the quadrupole system an "ion pool" forms within the potential well which slowly fills with ions, whereby the ions in the ion pool are continuously further thermalized in the collision gas. The potential well of the "ion pool" with the ion reflector (48) is shown in FIG. 2 as a potential over a section of the longitudinal axis. The apertured diaphragm system (55) (FIG. 1) barring the ions now possesses a potential minimum directly in the axis, which forms a point-shaped overflow (49) (FIG. 2) over which the ions from the ion pool can slowly drain away out of the quadrupole system. A restoring potential of this type with a point-shaped overflow in the axis can easily be produced by the three apertured diaphragms (55) (FIG. 1) supplied with a DC voltage. The ions which drain out of the ion pool like this are very monoenergetic; it is thus possible, as mathematical simulations demonstrate, to generate ion beams which have an energy spread of only 0.2 electron volt.

The "ion pool" in FIG. 2 is here a symbolic representation. The filling of the pool and the associated spatial expansion of the ions is a result of the Coulombic repulsion of the ions. The surface (48) does not exist, of course, since the ions collect in a three-dimensional lobe with rotational symmetry. The surface (48) here actually indicates a particular pressure of the Coulomb potential which presses the ions against the pseudopotential of the quadrupole system and against the barrier potential of the diaphragm system. If the collection of ions is large enough to make this Coulomb pressure sufficiently high, the ions can drain away via the overflow potential of the diaphragm system. This effect produces the extraordinarily good energy homogeneity of the ions draining away.

If the ions are injected through the injection diaphragms (53) with sufficient energy, most of them are fragmented. The conditioning cell then acts as a collision cell for the fragmentation of the ions (CID=collisionally induced decomposition).

This embodiment of a collision cell can be used for an arrangement which, according to FIG. 1, comprises a selective quadrupole filter mass spectrometer (52), the quadrupole system (54) forming the collision cell, a pulser (56) for the ion beam in the time-of-flight mass spectrometer and the apertured diaphragm systems (51), (53) and (55).

Figure 3:
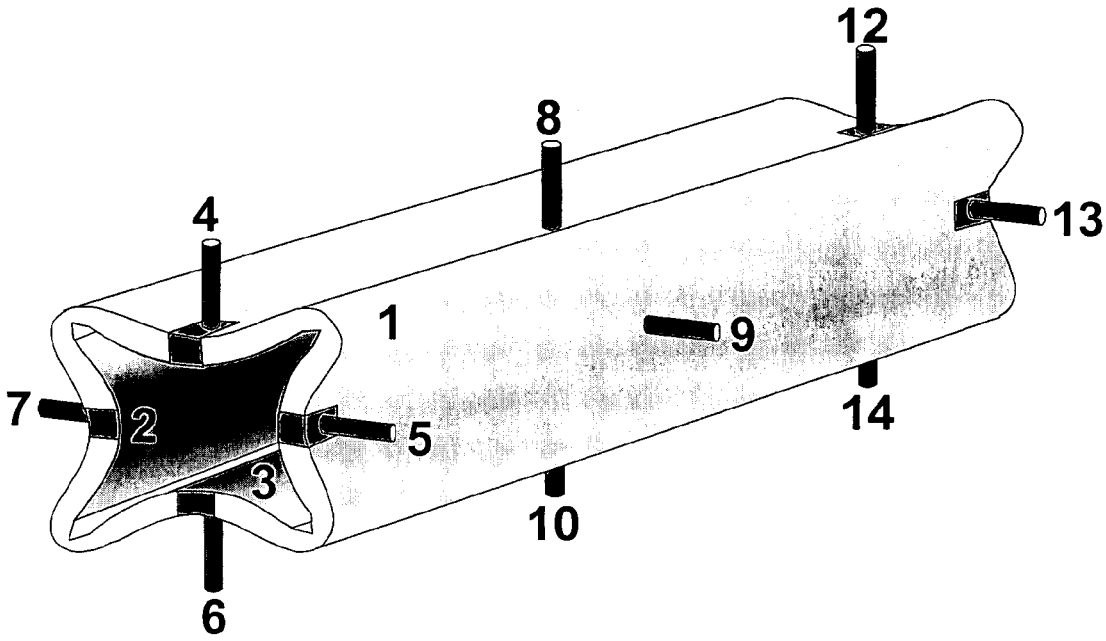
FIG. 3 represents a glass quadrupole system which can form the essential part of a conditioning cell. The apertured diaphragm systems on both sides are not shown. The hyperbolic electrode sheets (2, 3) are melted onto the inside of the glass body (1), and the insulated resistance layers are vapor deposited onto these. The connector pins (4, 5, 6, 7 and 12, 13, 14) bring the DC voltage to the resistance layers, the connector pins (8, 9, 10) guide the RF voltage to the electrode sheets.

A preferred embodiment of the quadrupole system for the collision cell assumes, as shown in FIG. 3, a normal monolithic glass quadrupole (1) with melted-on hyperbolic sheet surfaces (2, 3), as described in DE 27 37 903 (U.S. Pat. No. 4,213,557). The glass quadrupole system is formed in one operation in a hot molding process and fused with the sheet electrodes (2, 3) and is thus relatively inexpensive to manufacture. It is extraordinarily precise in maintaining all dimensions.

The hyperbolic surfaces (2, 3) of a glass quadrupole of this type are thinly coated with insulating paint and after drying in the vacuum, a thin layer of chromium is vapor deposited which acts as the electrically conductive surface layer. The chromium layer deposited in this process is only a few nanometers thick, it is possible in this case to generate a resistance of around five kilohms with good reproducibility. The chromium layer extends here to the end surfaces and also covers the front area of the glass so that connector pins (4, 5, 6, 7, 12, 13, 14) can be connected with the chromium layer on the electrodes (2, 3) via a conductive paint. For a voltage drop of five volts, a current of one milliampere flows with a loss of power of five milliwatts. A voltage drop of five volts is more than sufficient; a smaller voltage drop is usually used.

Instead of the chromium layer it is also possible to apply a layer of another metal. At a defined position, the chromium layer can be connected to the hyperbolic electrode underneath by means of a gap in the insulating layer as schematically represented in the supply diagram in FIG. 5. It is then possible to produce sections with different voltage drops.

Figure 5:
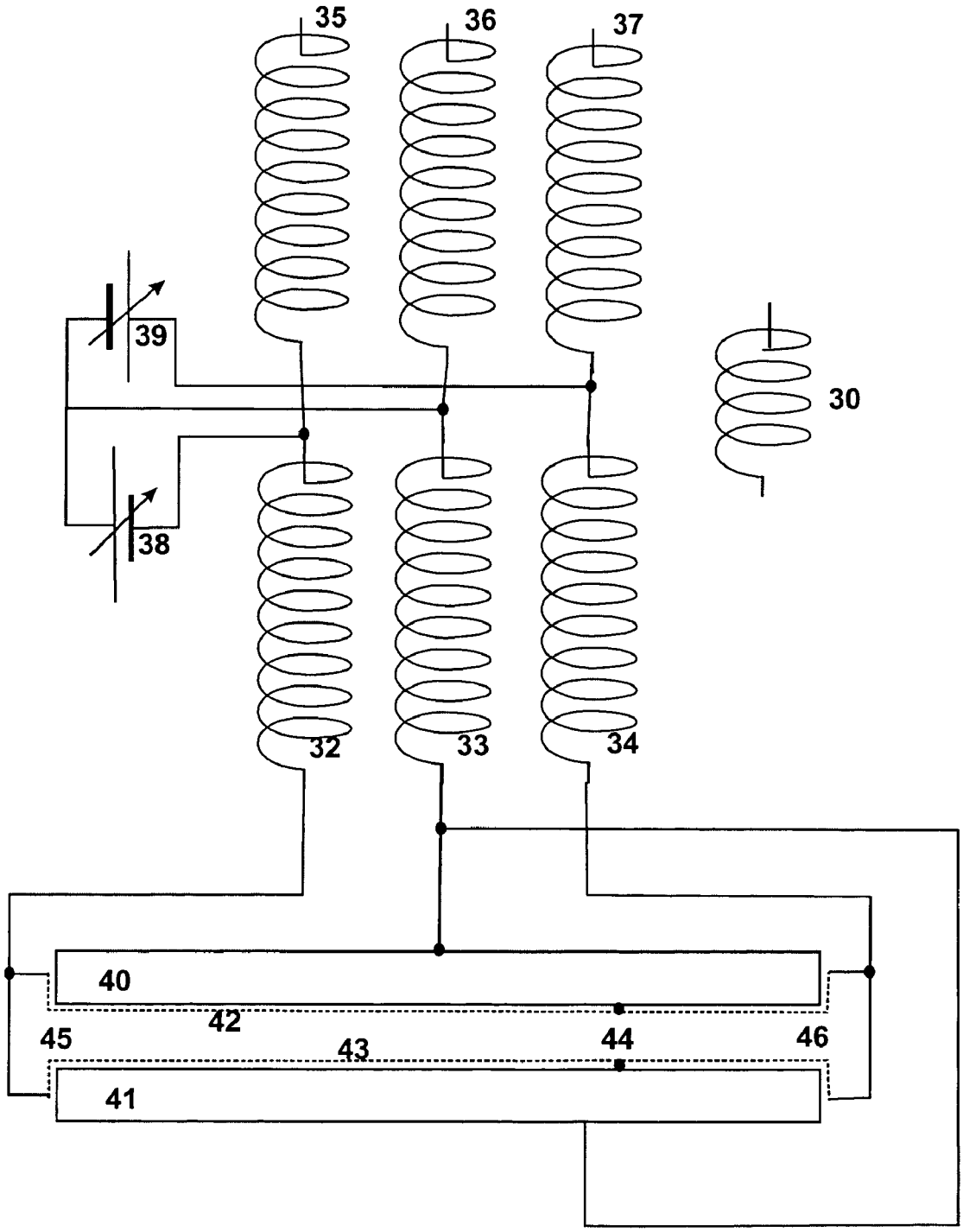
FIG. 5 depicts an example of a diagram of the voltage supply with mixing of the RF phases and the DC voltage potentials; a transformer with three secondary windings is used to generate two potential gradients.

A favorable embodiment for the voltage supply is illustrated schematically in FIG. 5. A transformer is used for the voltage supply which uses a primary winding (30) and three secondary windings (34, 37), (32, 35) and (33, 36), each with a center tap. The secondary windings are (unlike the schematic drawing which makes use of the form usually used in electrical engineering) all wound on the same core with the same coupling to the primary winding (30). This can be an air core transformer or a transformer with magnetic core, for example with ferrite core. The hot ends of the secondary winding (33, 36) supply the four hyberbolic electrode sheets in the usual way, electrodes (40, 41) positioned opposite each other each being supplied with the same phase (the two other electrodes and their supply are not shown here).

Two independently variable DC voltages (38) and (39) are fed into the center taps of the two other secondary windings (34, 37) and (32, 35) and the aforementioned secondary winding (33, 36). The ends (32) and (34) of these windings are each connected with the ends of the insulated chromium layers (42, 43) applied to the electrodes (40, 41) in such a way that a DC current flows through the windings and the chromium layer, generating a voltage drop while, at the same time, the RF alternating voltage is also applied across both ends. The resistance layers (42, 43) are connected with the hyperbolic electrodes below at position (44), it is therefore possible to generate two independent voltage drops in the sections (45, 44) and (44, 46) of the quadrupole system.

The RF alternating voltage of these feeds does not have to supply all the chromium layers (42, 43) with RF voltage in this case, since there is capacitive coupling between the RF voltage through the insulating paint and the hyperbolic electrodes (40, 41), which are good conductors. This simple circuit avoids the use of capacitors, resistances or inductors to connect the hot side of the transformer windings. It is possible to use a litz wire made of three braided strands for the windings, for example.

Since the electrically conductive surface layers (42) and (43), which each form a resistance layer insulated from the hyperbolic electrodes (40) and (41), are connected at position (44) with the hyperbolic electrodes (40) and (41) below, it is possible to form the voltage drop in the two partial sections (45, 44) and (44, 46) separately. The two independently adjustable potential gradients can be used to greatly vary the size of the pool which results in the overflow. A very small voltage drop in the larger part of the quadrupole system and a slightly higher potential gradient in front of the ejection diaphragm system make it possible to produce a small pool.

The two independent voltage drops in the sections (45, 44) and (44, 46) make it possible to empty the ion pool more rapidly at the end of a measurement by using a continuous increase of the voltage drop (44, 46) to reduce the expansion of the pool and by completely draining the pool via the potential channel in the apertured diaphragm system on the output side.

The glass quadrupole system of FIG. 3 is eminently suitable for filling with collision gas. Clean nitrogen can be used for this, it is not necessary to use expensive helium in this case since, even with collision gases of higher molecular weights, the collision cascades with random lateral deflection do not lead to noticeable ion losses. Nitrogen as the collision gas has a higher fragmentation yield. It is even possible to use argon as the collision gas, producing an even higher fragmentation yield. It is advisable to make the injection and ejection apertures as fine as possible in order to be able to keep the pressure in the collision cell high without worsening the vacuum in the surrounding mass spectrometers by providing them with more collision gas than they can tolerate. A higher pressure leads to more rapid fragmentation and thermalization, which is particularly favorable for pulsed operation.

Gas mixtures, for example helium and argon, can create an equilibrium between thermalization and fragmentation. In this case, the helium is mainly responsible for the thermalization, the argon for the fragmentation. The mixture enables the desired ratio of fragmentation to kinetic cooling to be produced.

As illustrated in FIG. 1, the hyberbolic quadrupole system (54) is sealed on both sides with apertured diaphragm systems (53) and (55). The apertured diaphragm system on the input side (53) provides the accelerating voltage for the subsequent fragmentation, the apertured diaphragm system on the output side (55) provides only a fine potential minimum in the axis to drain away thermalized ions, otherwise it is ion repulsive. The parent ions are selected in the quadrupole system (52). The usual method here is to select the whole isotope group of the parent ions in order to recover the isotope groups in the daughter ion spectrum; the specific mass range selected is therefore roughly between three and five mass units per elementary charge. The parent ions which are injected with energies of between 30 and 200 electron volts will first traverse the collision cell (54) with a few hundred collisions and be reflected on the output side of the diaphragm system (55). On returning to the diaphragm system on the input side (53) they are reflected again; they thus oscillate in the hyperbolic quadrupole system (54) until they are thermalized. This causes a proportion of the ions to be fragmented, this proportion depending on the collision density and the power of the collision. The collision density is given by the number, the power of the collision by the mass of the collision gas molecules. The thermalized ions collect in the axis of the quadrupole system, in the minimum of the pseudopotential.

The slight DC voltage drop along the quadrupole system (54) allows the thermalized ions to flow towards the output in front of the diaphragm system (55), where they collect in the "ion pool". According to the invention, the potential of the outflow aperture in the axis of the diaphragm system (55) is kept high enough so that a certain quantity of thermalized ions must first fill the ion pool with a certain "overflow pressure" before the ions can emerge over the slight potential threshold in the outlet hole. As described above, the overflow pressure is formed by the Coulombic repulsion of the ions in the ion pool. This overflow out of an ion pool provides ions with extraordinarily homogeneous energies ("monoenergetic" ions).

It is possible to form an ion beam out of the outflowing monoenergetic ions which is eminently suitable for a time-of-flight mass spectrometer with orthogonal injection. The non-thermalized ions which occasionally emerge from the fine aperture, ions which can only emerge when they, by a rare coincidence, aim directly at this potential hole, are not a problem in the subsequent time-of-flight mass spectrometer because their velocity is too high and they either quickly completely sweep through the pulser or, alternately, they cannot hit the ion detector at the end of the flight path after being ejected as a pulse in the pulser. If the ions are injected into the collision cell with a small angle, their chance of escaping unthermalized from the overflow potential channel is reduced. Injection at a small angle is the norm for ions coming out of a selective quadrupole system, since the radial oscillation of the ions in the selective quadrupole occurs to a large extent unhindered.

The quantity of ions in the ion pool, which brings about the draining, depends on the profile of the DC voltage along the quadrupole system. As described above, this profile can be generated by three or more windings of the RF transformer. Controlling the voltage drop in front of the apertured diaphragm system on the output side makes it possible to empty the pool after measuring a daughter ion spectrum slowly and completely.

Figure 4:
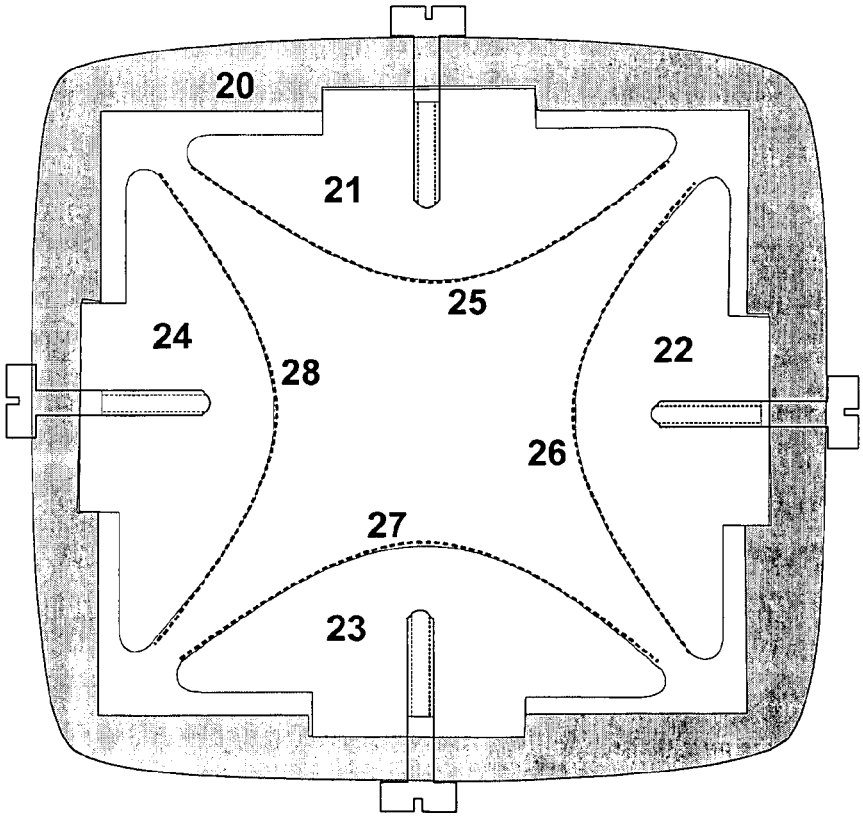
FIG. 4 illustrates a quadrupole system made of rigid aluminum electrodes (21, 22, 23, 24), on whose anodized oxide layer the resistance layers (25, 26, 27, 28) are applied, screwed into a glass holder (20) with a precise internal cross section.

The quadrupole system with hyperbolic electrodes can be constructed in a completely different way, as shown in FIG. 4. For example, four electrodes (21, 22, 23, 24) can be manufactured out of aluminum with a hyperbolic electrode surface on the front and shaped on the rear so that there is a good screw fit in a retaining insulator (20). The retaining insulator (20) can be produced out of glass, for instance, using a method for producing so called "calibrated precision glass", for example. The aluminum electrodes (21, 22, 23, 24) are strongly anodized on the hyperbolic side at least, thus forming a nonconducting oxide layer. A thin layer of metal is then, in turn, vapor deposited onto this layer in order to produce the resistance layers (25, 26, 27, 28) on the surface. The vapor is again deposited only on the hyperbolic surface here. The screw-fastened system is bonded in a similar way to the quadrupole system made of hyperbolic sheets which are melted onto the glass.

The collision cells according to the invention are particularly suitable for operation with a quadrupole mass spectrometer for selecting the parent ions, and with a time-of-flight mass spectrometer with orthogonal ion injection for analyzing daughter ions, as shown in FIG. 1. The time-of-flight mass spectrometers provide extraordinarily good accuracy for mass determination; even with relatively small table-top instruments it is possible to obtain mass determinations to an accuracy of two to three millionths of the mass in a mass range of around 200 to 4000 atomic mass units, i.e. eminently suitable for the exceedingly interesting use in the field of protein and peptide analysis. This method is especially good for de-novo sequencing of peptides, i.e. the determination of the sequence of amino acids with no additional prior knowledge.

Time-of-flight mass spectrometers with orthogonal injection of a primary ion beam have a pulser (56) at the beginning of their flight path which accelerates a section of the primary ion beam, i.e., a fine string-shaped ion package, at right angles to the previous direction of the beam. This forms a ribbon-shaped secondary ion beam (58) in which light ions fly quickly and heavier ones more slowly, and whose direction of flight lies between the previous direction of the primary ion beam and the direction of acceleration at right angles to this. A time-of-flight mass spectrometer of this type is usually operated with a velocity-focusing reflector which reflects the whole width of the ribbon-shaped secondary ion beam and deflects it onto a detector which is also extended.

The resolution of this time-of-flight mass spectrometer depends on the quality of the primary ion beam, as described in the introduction. The primary ion beam must therefore be conditioned with respect to spatial and velocity distribution in order to achieve a high mass resolution in the time-of-flight mass spectrometer. This conditioning of the primary ion beam can be achieved by using the collision cell according to the invention.

A collision cell according to the invention can be operated both in continuous mode and also in a pulsed mode. The pulsed mode injects a predefined quantity of parent ions, allows them to oscillate backwards and forwards in the collision cell preferably without significant DC voltage drop until their kinetic energy has been absorbed by cooling or fragmenting collisions, and then empties the collision cell by increasing the decreasing DC voltages. The ions are then transported to the output, where they collect in the ion pool and can escape monoenergetically through the potential minimum in the center of the apertured diaphragm system. The pulsed mode can be repeated here for every spectrum of the time-of-flight spectrometer; fragmentation, thermalization and emptying must then take place very quickly. With a scan rate of ten kilohertz, each pulse operation must be completed in 100 microseconds, something which is only possible with very high collision gas pressures and which requires the DC voltages to be increased very rapidly. The quality of the beam suffers as a result, even with a scan rate of three kilohertz, the voltages of DC voltage drop and the apertured lens system must be very carefully matched in order to obtain a well-conditioned ion beam.

It is also possible to choose a slow pulsed mode in which one pulse encompasses the scan of a total of around 1000 individual spectra for a daughter spectrum, the daughter spectrum being scanned in around a tenth of a second.

Figure 6:
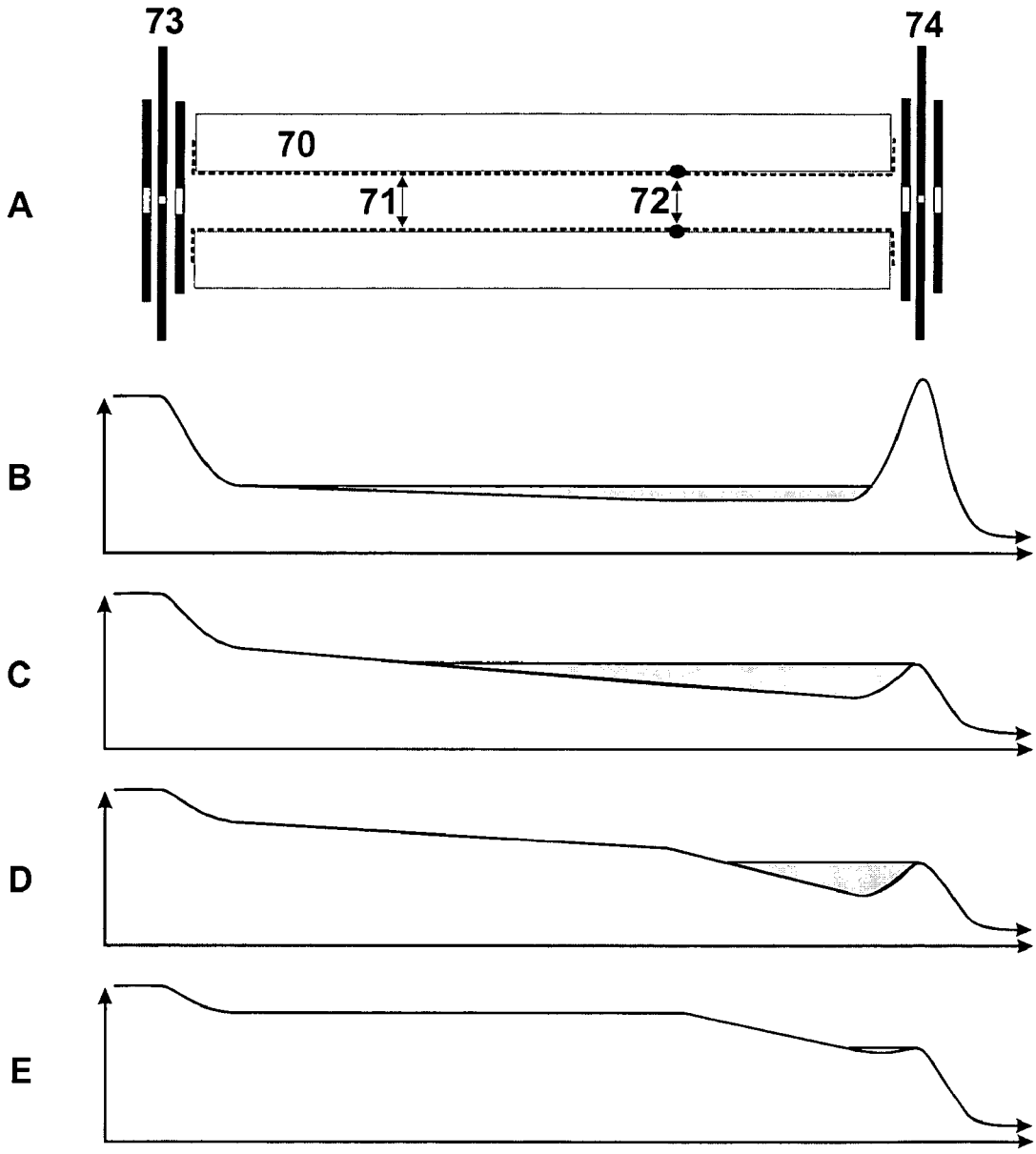
FIG. 6 is a schematic diagram of a quadrupole system (row A) with longitudinal electrodes (70) and resistance layer (71) with through-hole plating (72) and underneath the filling (row B) and emptying of the ion pool (rows C to E) by changing the DC potentials in the quadrupole system and across the exit diaphragm system (74).

It is also possible, however, to have pulsed operation with a period of around five milliseconds. In this case, the parent ions are injected for around a millisecond, for example out of an ion pool in the preceding selective quadrupole system. The ions then get around two milliseconds for fragmentation, thermalization and collection in the ion pool. This requires a collision gas pressure of around one to ten Pascal. After this, the ions are allowed to flow out of the ion pool for around two milliseconds, whereby the potential gradient of the ion pool is continuously increased, until the ion pool is practically empty. The emptying of the ion pool is shown schematically in FIG. 6 in several phases. Residues in the ion pool are not a problem, since immediately afterwards, a new filling period with the same parent ions begins.

This method of emptying the ion pool should produce excellent results with respect to the energy homogeneity and the composition of the ions. With longer collection phases, the heavy and the light ions in the ion pool segregate because the action of the pseudopotentials is mass-dependent. Collection phases which are too long when there is a good supply of ions then lead to a loss of heavy ions.

A pulsed mode of this type does not use the subsequent time-of-flight mass spectrometer to the full. The spectra are only ever taken for an interval of two milliseconds in a period of five milliseconds, the scanning of the spectra therefore occurs only 40% of the time. This has the effect of reducing the dynamic measuring range by a factor of 2.5. Nevertheless, this type of operation has proven to be advantageous for the resolution of the spectra and the accuracy of the mass spectra. If the total duration of the scan of a daughter ion spectrum is a tenth of a second, then with ten kilohertz scanning frequency, only 400 instead of 1000 daughter ion spectra are scanned and added. However, since the daughter ion spectra, which, after all, only utilize a fraction of the ions allowed into the mass spectrometer, practically never fully extend the ion detector and the digitalization electronics, this mode is desirable.

Knowledge of this invention makes it possible for those skilled in the art to set up yet more modes of operation for other types of analytical tasks using analogous methods.

What is claimed is:

1. Method to produce a fine monoenergetic ion beam comprising the steps:

(a) injecting ions into a gas-filled conditioning cell with a longitudinal axis and a terminal exit diaphragm system, whereby the ions thermalize, (b) collecting the thermalized ions in a potential well that extends along the axis in front of the exit diaphragm system, and (c) draining thermalized ions out of the conditioning cell via a central potential minimum in the exit diaphragm system, thus generating a fine beam whose ions have a high degree of energy homogeneity.

2. Method according to claim 1, wherein the steps (a) of introduction with thermalization, (b) of collection and (c) of draining of the ions take place over a predetermined period of time simultaneously and continuously.

3. Method according to claim 1, wherein the step (a) of introduction with thermalization and the step (b) of collection form a first phase of the method, and the step (c) of draining forms a second phase, whereby during the draining, the voltage drop along the conditioning cell is temporally changed to make it possible for the draining to continue until it is empty.

4. Method according to claim 1, wherein a conditioning cell is constructed of parallel ring electrodes.

5. Method according to claim 1, wherein a conditioning cell is used which consists of one or more helical, coiled pair of wires.

6. Method according to claim 1, wherein a conditioning cell is used which consists of parallel longitudinal electrodes which generate a multipole RF field.

7. Method according to claim 6, wherein a conditioning cell is used in which four longitudinal electrodes are used to generate a predominantly quadrupolar RF field and in which insulated resistance layers can be used to generate DC voltage potential gradients in the longitudinal direction.

8. Method according to claim 7, wherein the quadrupolar RF field is generated as free as possible from superimpositions with higher multipole fields by designing the longitudinal electrodes which generate the RF field so that they have a hyperbolic shape towards the interior.

9. Method according to claim 1, wherein the ions in the conditioning cell are fragmented by collisions by being injected into the collision-gas filled conditioning cell at step (a) of the method with energies of between 30 and 200 electron volts.

* * * * *